US009647390B1

(12) United States Patent
Creato et al.

(10) Patent No.: US 9,647,390 B1
(45) Date of Patent: May 9, 2017

(54) POWER CORD LOCK

(71) Applicants: Timothy Frost Creato, Edgartown, MA (US); Michael J Creato, Edgartown, MA (US)

(72) Inventors: Timothy Frost Creato, Edgartown, MA (US); Michael J Creato, Edgartown, MA (US)

(73) Assignee: Creato, Inc., Edgartown, MA (US)

( * ) Notice: Subject to any disclaimer, the term of this patent is extended or adjusted under 35 U.S.C. 154(b) by 0 days.

(21) Appl. No.: 15/011,417

(22) Filed: Jan. 29, 2016

(51) Int. Cl.
*H01R 13/62* (2006.01)
*H01R 13/639* (2006.01)

(52) U.S. Cl.
CPC ..... *H01R 13/6392* (2013.01)

(58) Field of Classification Search
CPC ..... H01R 13/639; H01R 13/6392; H01R 13/6395; H01R 13/6397
USPC ..... 439/369–372
See application file for complete search history.

(56) References Cited

U.S. PATENT DOCUMENTS 2,406,567 A * 8/1946 Schueneman ..... H01R 13/6392 439/369
2,903,669 A * 9/1959 Gilman ..... H01R 13/6392 174/135
4,145,105 A * 3/1979 Dobson ..... H01R 13/6392 439/369
5,766,032 A * 6/1998 LaPointe ..... F21V 19/0095 439/366
5,782,648 A * 7/1998 Peterson ..... H01R 13/6392 24/16 PB
6,319,044 B1 * 11/2001 Stekelenburg ..... H01R 13/6392 439/369
7,186,130 B1 * 3/2007 Miller ..... H01R 13/639 439/369
7,407,405 B1 * 8/2008 Slenczka ..... H01R 13/6392 439/369

* cited by examiner

*Primary Examiner* — Hien Vu
(74) *Attorney, Agent, or Firm* — Stahl Law Firm

(57) ABSTRACT

The present invention relates to cord locks to secure connections of cords, especially electric cords. Cord locks of the present invention can be used to prevent the undesired separation of male and female cord plugs.

18 Claims, 12 Drawing Sheets

POWER CORD LOCK

1.0 FIELD OF THE INVENTION

The invention relates to power cord locks to prevent extension cords from disconnecting as easily as they would without a cord lock of the current invention.

2.0 BACKGROUND

Extension cords are used for many applications, for example, tools, household appliances, lawnmowers, and many other applications. Typically, power cords are connected by inserting a plug into a socket (or a male plug into a female plug) or connecting a power cord to another power cord. During use of the cord, tension may be applied and result in the disconnection of the cord. It would be desirable to have a convenient and effective cord lock to prevent easy disconnection of power cords during use. The invention discloses such cord locks.

3.0 SUMMARY OF THE INVENTION

The present invention relates to cord locks for use with power cords, for example, so that power cords that are connected to each other cannot be disconnected as easily as without the use of a cord lock of the present invention. A cord lock of the present invention, in certain embodiments, can be attached to a male plug and a female plug of one or more electric cords. A cord lock of the current invention, in certain embodiments, comprises a bar. A cord lock of the current invention, in certain embodiments, comprises a locking mechanism. A cord lock of the current invention, in certain embodiments, comprises a fastening band.

In certain embodiments, a bar of a cord lock of the current invention can be connected to a power cord, for example, to a male plug of a power cord, to a female plug of a power cord, and/or to a cord of a power cord. A bar of a cord lock of the current invention, in certain embodiments, can be connected to a power cord through a locking mechanism and/or a fastening band. A bar of a cord lock of the current invention, in certain embodiments, can be connected to a power cord by entangling the bar with the power cord, for example, by designing a section of the bar in the shape of a pigtail or some other shape capable of holding a power cord, for example, by entangling the power cord. A bar of a cord lock of the current invention, in certain embodiments, comprises a bar stop, a bar tooth right angle surface, a bar tooth slanted surface and/or a pigtail opening.

A locking mechanism of a cord lock of the current invention, in certain embodiments, is capable of holding on to a power cord, for example, to a male plug of a power cord, to a female plug of a power cord, and/or to a cord of a power cord. A locking mechanism of a cord lock of the current invention, in certain embodiments, is capable of holding on to a bar and/or a fastening band of a cord lock of the current invention. A locking mechanism of a cord lock of the current invention, in certain embodiments, comprises a body, a locking arm, a locking arm spring, and/or a locking arm hinge pin. In certain embodiments, a locking mechanism of the current invention is connected to a power cord through a fastening band. A locking arm of a cord lock of the current invention, in certain embodiments, comprises a locking arm right angle surface, a locking arm slanted surface, and/or a locking arm finger tab.

A fastening band of a cord lock of the current invention, in certain embodiments, is capable of holding on to a power cord, for example, to a male plug of a power cord, to a female plug of a power cord, and/or to a cord of a power cord. A fastening band of a cord lock of the current invention, in certain embodiments, is capable of holding on to a locking mechanism of a cord lock of the current invention.

A cord lock of the current invention, in certain embodiments, is shaped to fit over cords and plugs that it is used with. A cord lock of the current invention, and its various components, may be made of any material, for example, a plastic, a rubber, a metal, a wood, or any other material that is sufficiently strong and flexible. In certain embodiments, the invention relates to methods for locking power plugs with a cord lock of the invention.

A cord lock of the current invention, in certain embodiments, can be used to strengthen an electric connection for an electric tool, a hand held electric tool, a drill, a saw, a sander, a light, a mower, a blower, a cutter, a light, any other kind of tool, an appliance, a household appliance.

4.0 BRIEF DESCRIPTION OF THE DRAWINGS

FIG. 1 shows a cord lock according to certain embodiments of the invention that is applied to the cord plug 2 of a female end, with a bar 15 holding on to a cord of a male end 3 through the pigtail 14 of the bar 15.

Figure 1:
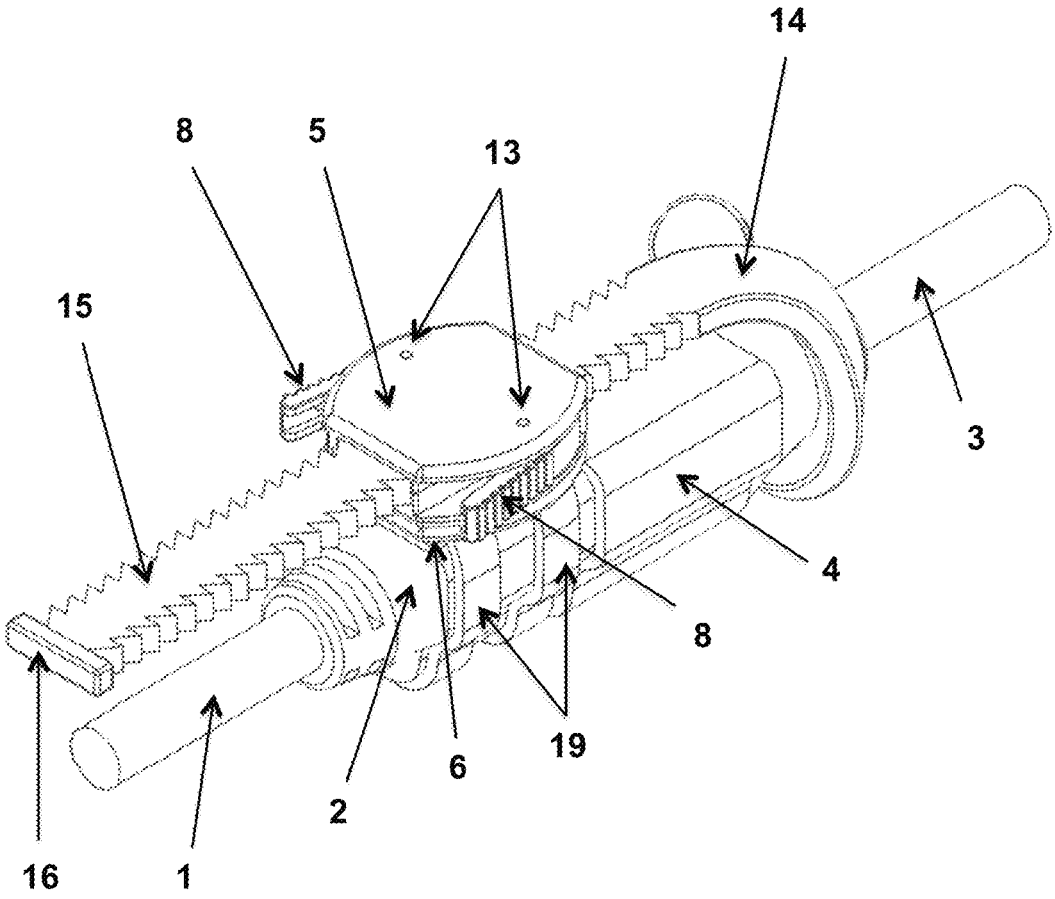
Figure 6:
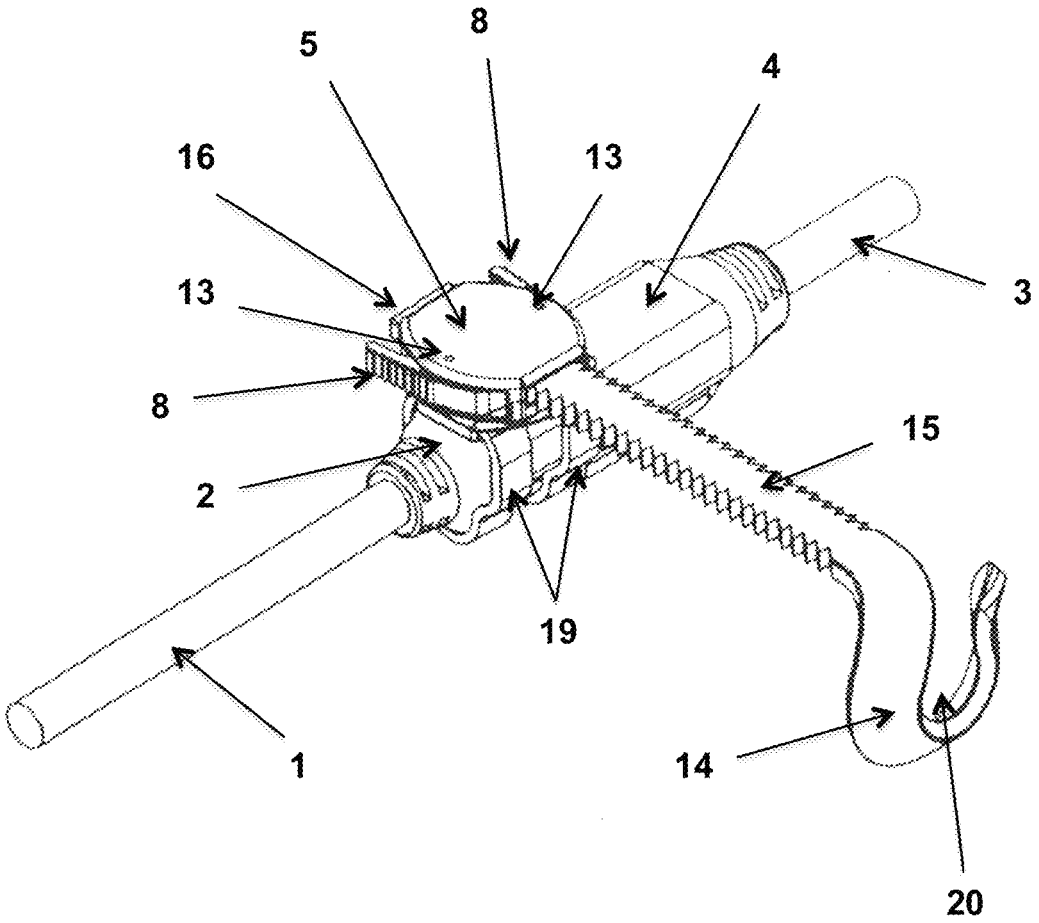

FIG. 6 shows the embodiment in FIG. 1. The bar 15 is in a more extended position than shown in FIG. 1 and the bar 15 is rotated away from the cord 3 whereby the cord 3 and the cord plug 4 are easier to access.

Figure 7:
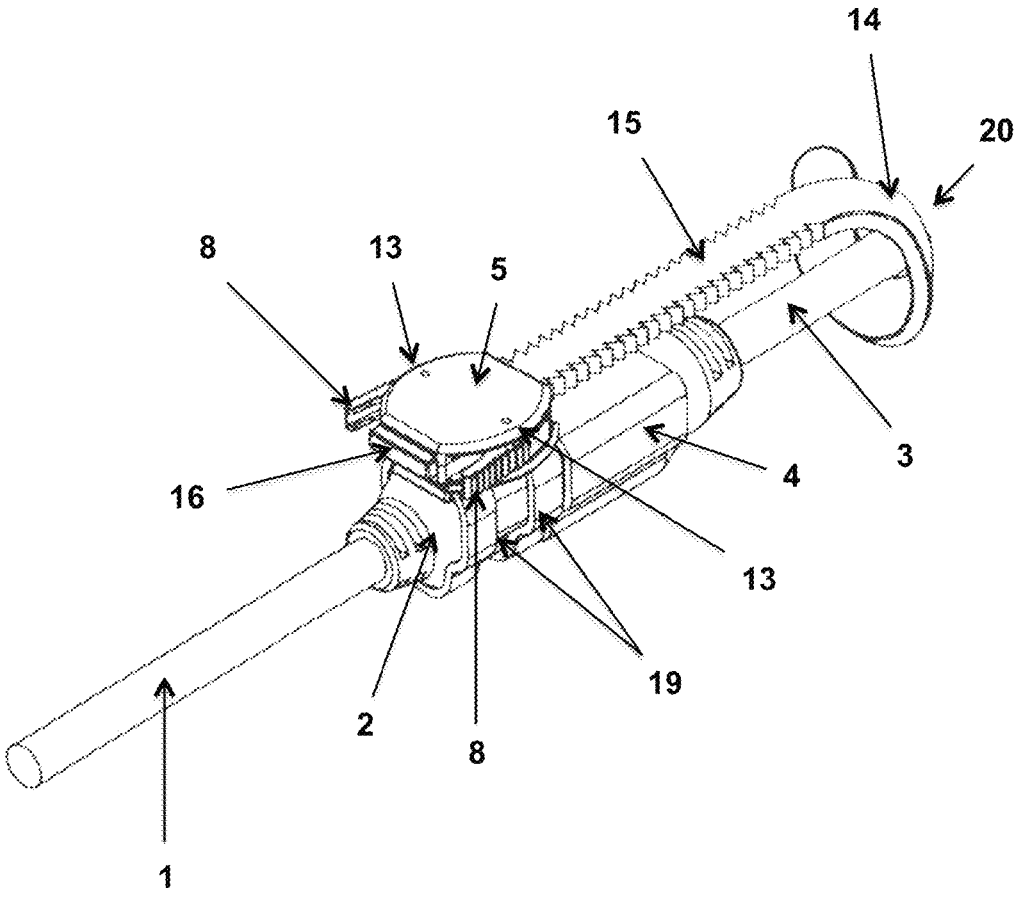

FIG. 7 shows the embodiment in FIG. 1. The bar 15 is in a more extended position than shown in FIG. 1. The bar 15 is not rotated away from the cord 3 as shown in FIG. 6. The cord 3 is in the pigtail 14.

Figure 8:
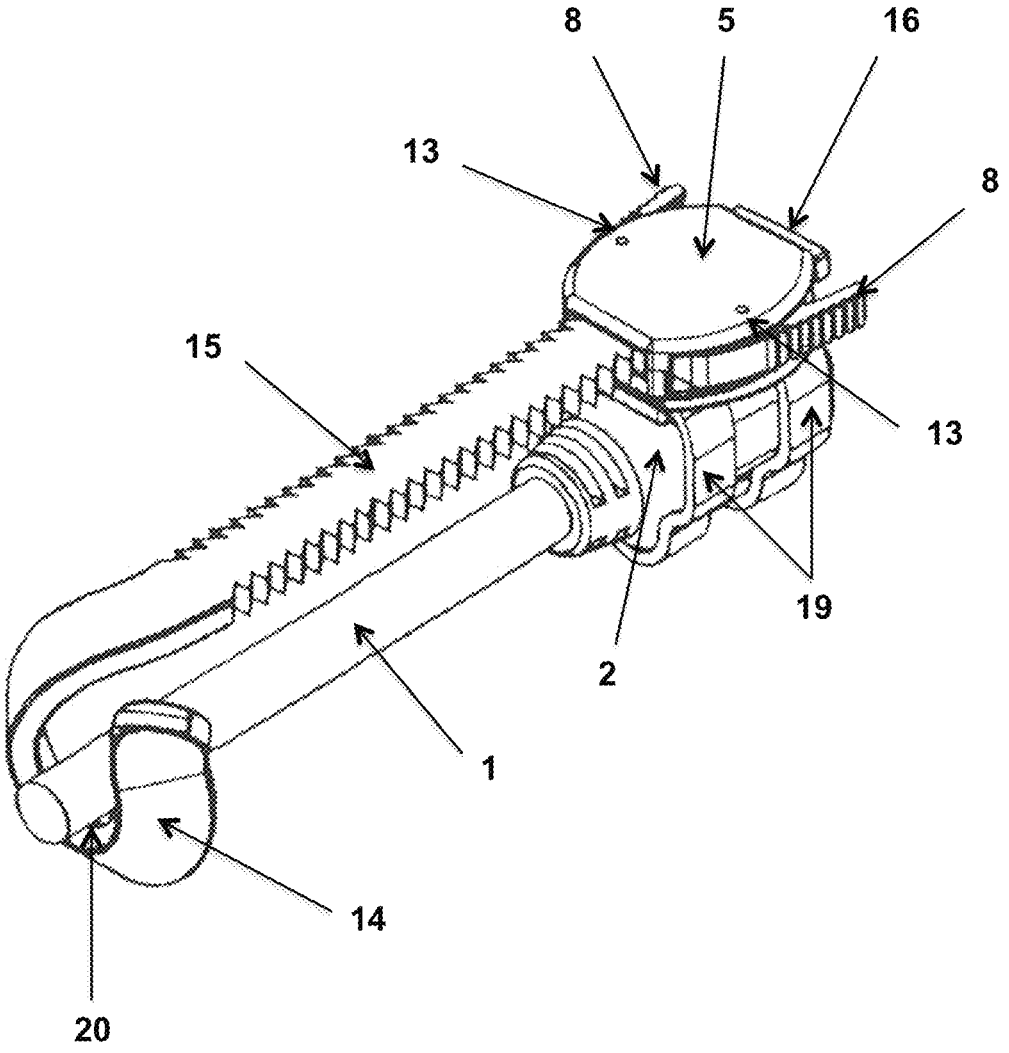

FIG. 8 shows a cord lock according to certain embodiments of the invention that is applied to the cord plug 2 of a female end, and wherein the cord plug 2 is not connected to another cord plug or an outlet. The bar 15 is in a non-locking position and the extension cord 1 passes through the pigtail opening 20.

Figure 9:
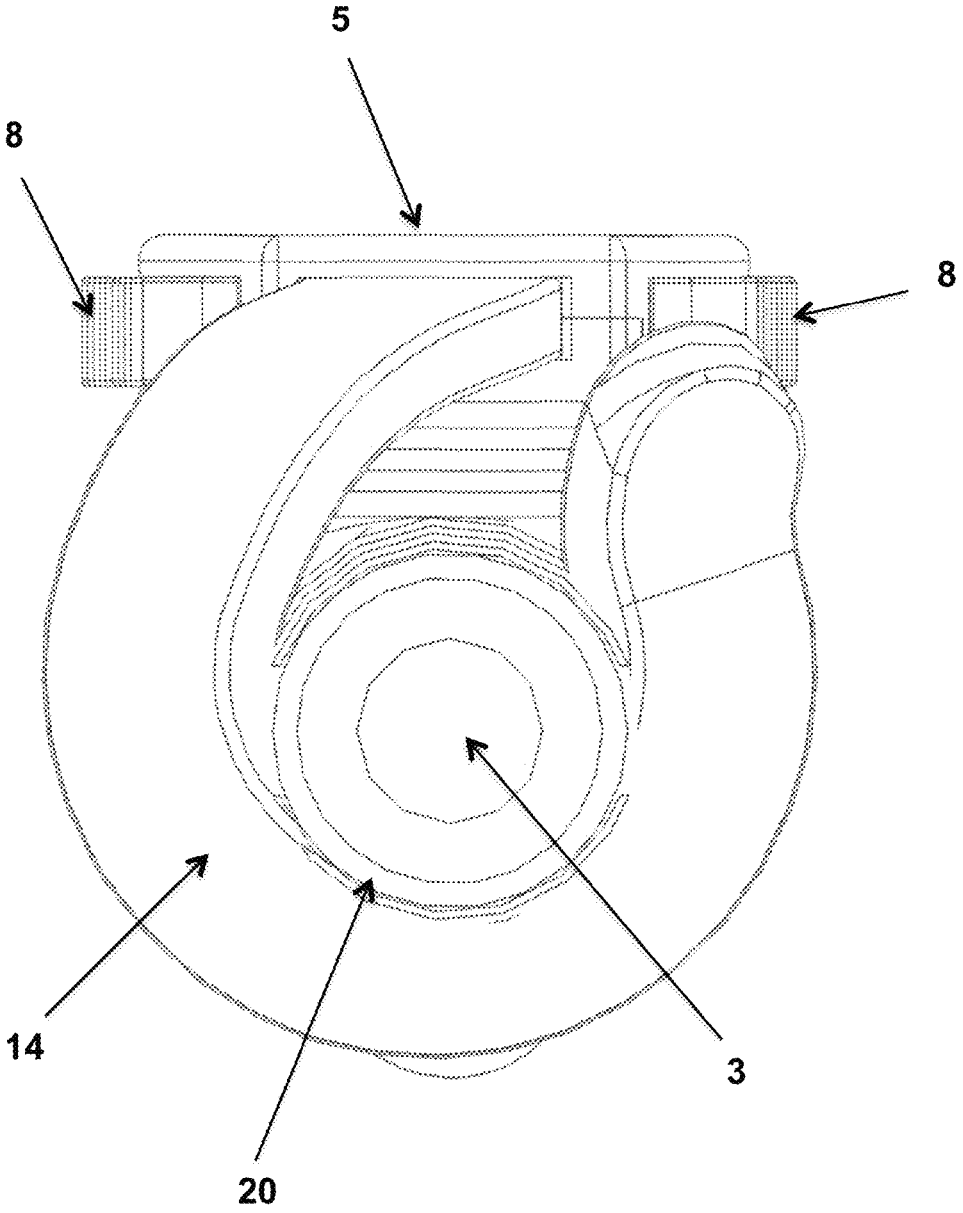

FIG. 9 shows a cord lock according to certain embodiments of the invention that is applied to the cord plug. The extension cord 3 passes through the pigtail opening 20.

Figure 10:
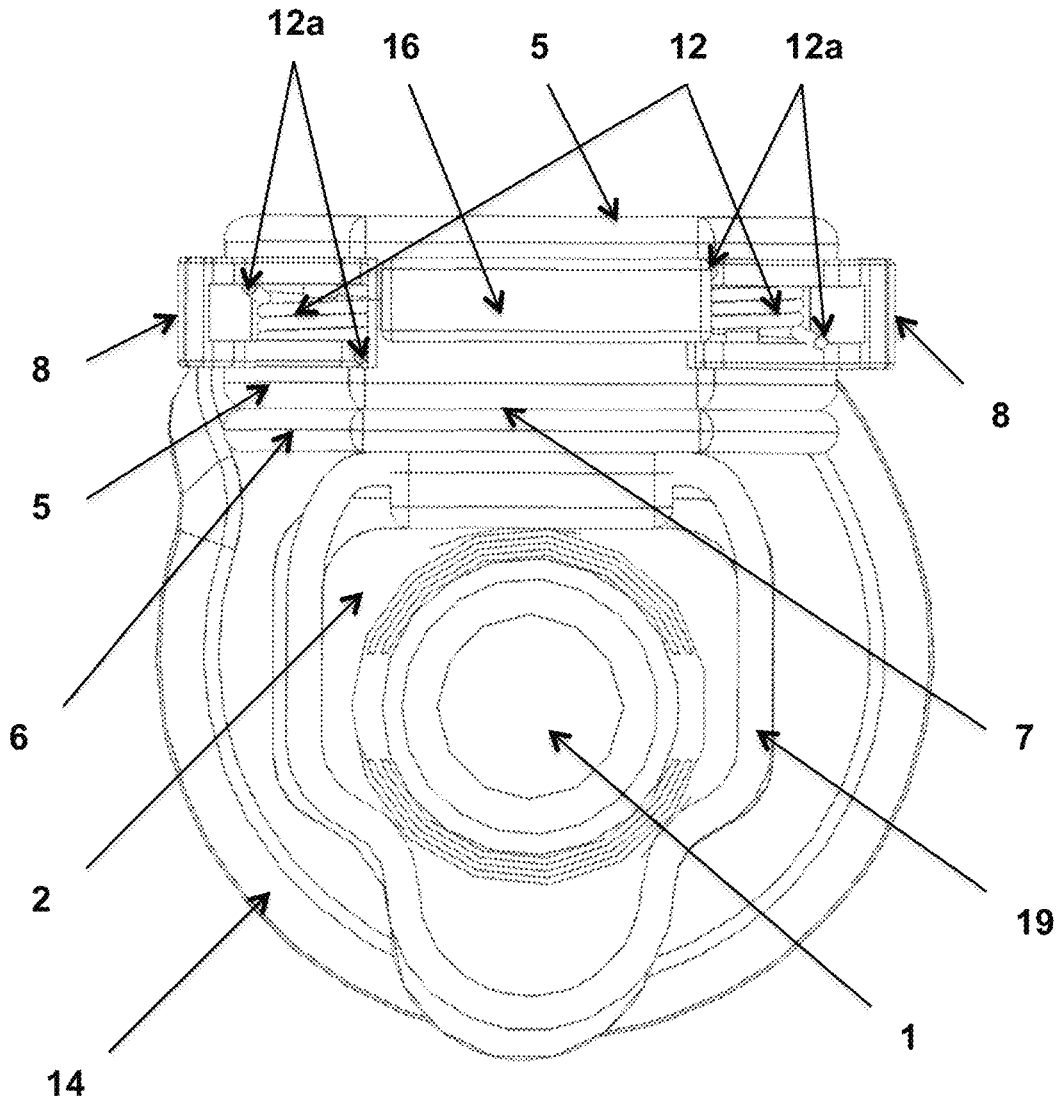

FIG. 10 shows a cord lock according to certain embodiments of the invention that is applied to the cord plug 2. A bar stop 16, a lock arm spring 12, and a fastening band 19 are shown.

Figure 11:
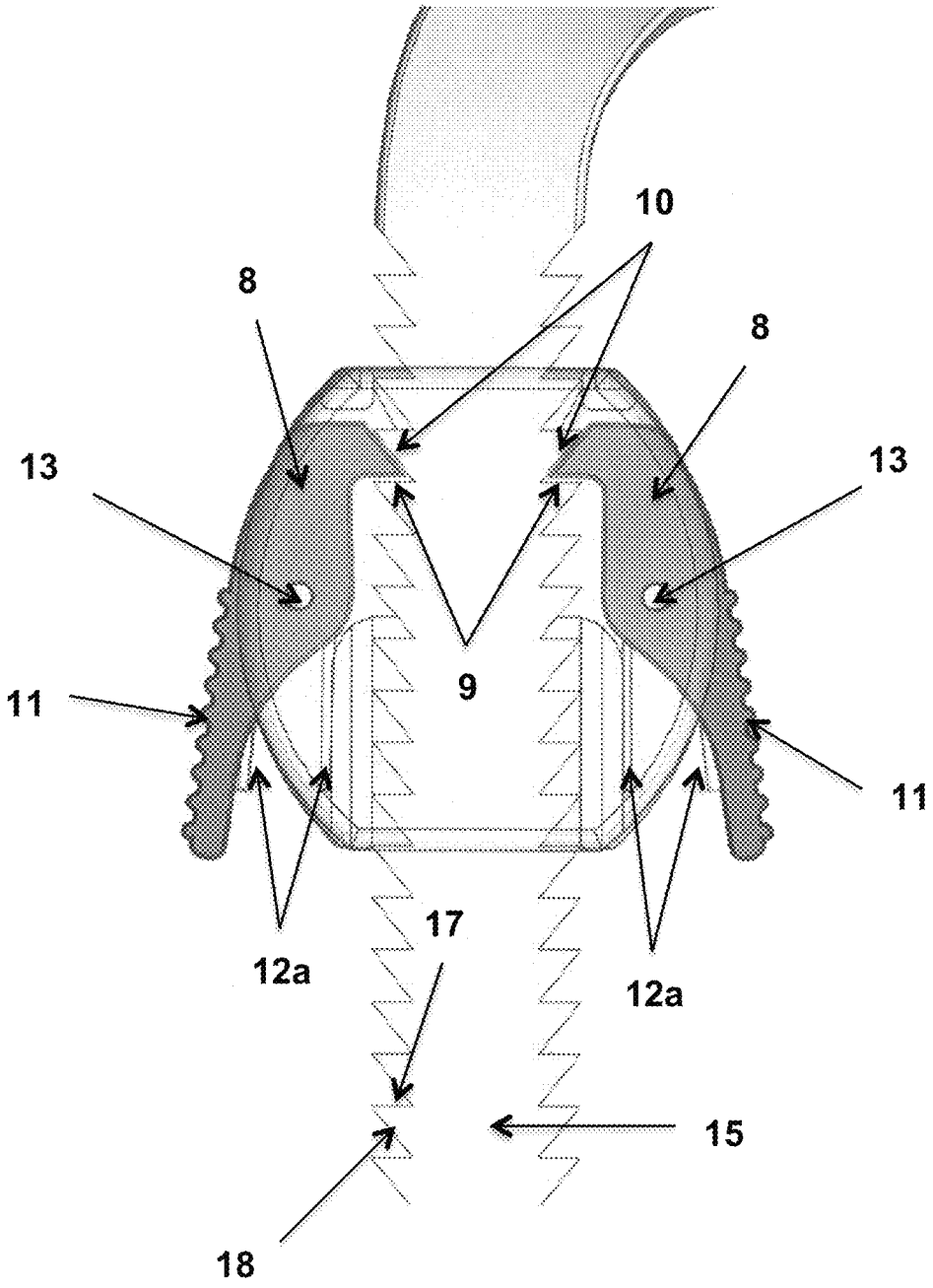

FIG. 11 illustrates the interior design of a locking mechanism of a cord lock according to certain embodiments of the invention.

Figure 12:
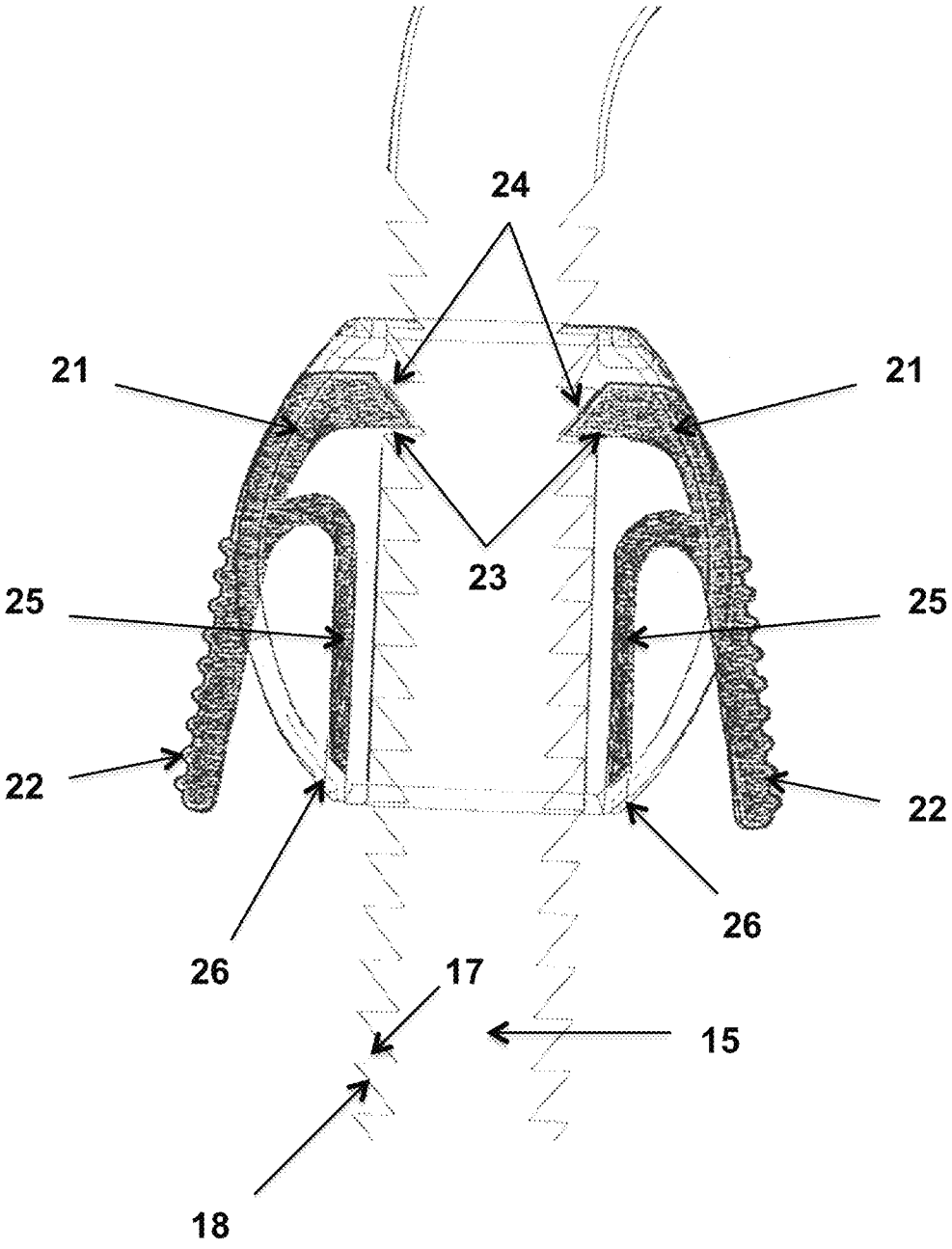

FIG. 12 illustrates the interior design of a locking mechanism without hinge pins 13 of a cord lock according to certain embodiments of the invention.

5.0 DETAILED DESCRIPTION OF THE INVENTION

The present invention relates to cord locks. A cord lock of the current invention may be used on a power cord, for example, on a connection of a power cord to another power cord. A cord lock of the current invention, in certain embodiments, can be used so that a power cord that is connected to something else, for example to another power cord, cannot be disconnected as easily as without the use of a cord lock of the present invention. A cord lock of the present invention, in certain preferred embodiments, can be attached to a male plug and/or a female plug of a power cord or electric cord or to a male plug and/or a female plug of more than one power cord or electric cord. A cord lock of the current invention, in certain embodiments, can be used with any kind of cord that is connected to something else in order to strengthen the connection.

A cord lock of the current invention, in certain embodiments, comprises a bar. A cord lock of the current invention, in certain embodiments, comprises a locking mechanism. A cord lock of the current invention, in certain embodiments, comprises a fastening band. A cord lock of the current invention, in certain embodiments, comprises a bar and a locking mechanism. A cord lock of the current invention, in certain embodiments, comprises a bar, a locking mechanism, and a fastening band.

A bar of a cord lock of the current invention, in certain embodiments, comprises a bar stop, a tooth, a bar tooth right angle surface, a bar tooth slanted surface, a pigtail and/or a pigtail opening. A bar of a cord lock of the current invention, in certain embodiments, has a bar stop on one end and a pigtail on the other end. In certain embodiments, a bar of a cord lock of the current invention can be connected to a power cord, for example, to a male plug of a power cord, to a female plug of a power cord, and/or to a cord of a power cord. A bar of a cord lock of the current invention, in certain embodiments, can be connected to a power cord through a locking mechanism and/or a fastening band. A bar of a cord lock of the current invention, in certain embodiments, can be connected to a power cord by entangling the bar with the power cord, for example, by designing a section of the bar in the shape of a pigtail or some other shape capable of holding a power cord, for example, by entangling the power cord. A bar of a cord lock of the current invention, in certain embodiments, can be connected to a power cord in one location or in two, three, four, five or more locations. A bar of a cord lock of the current invention, in certain embodiments, can be connected to two power cords, preferably two power cords that are connected to each other, in one location or in two, three, four, five or more locations.

A bar of a cord lock of the current invention, in certain embodiments, has a reach that is measured as the maximum extension of the bar along its the longitudinal axis, which is the axis running through and parallel to the section of the bar having teeth 15 as shown in FIG. 1. A bar of a cord lock of the current invention, in certain embodiments, has a reach equal to or about equal to the length of the housing or body of a cord plug (in other words, not including the length of the contacts) for which the cord lock is designed or intended, or 1.5× (in other words, 1.5 times) or about 1.5× that length, or 2× or about 2× that length, or 2.5× or about 2.5× that length, or 3× or about 3× that length, or 3.5× or about 3.5× that length, or 4× or about 4× that length, or 4.5× or about 4.5× that length, or 5× or about 5× that length, or 5.5× or about 5.5× that length, or 6× or about 6× that length, or 7× or about 7× that length, or 8× or about 8× that length, or 1×-8× or about 1×-8× that length, or 2×-6× or about 2×-6× that length, or 3×-6× or about 3×-6× that length, or 3×-5× or about 3×-5× that length, or 3×-4× or about 3×-4× that length, or 2×-4× or about 2×-4× that length, or 2×-5× or about 2×-5× that length.

A bar of a cord lock of the current invention, in certain embodiments, has a maximum width that is equal to or about equal to the width of an electric cord for which the cord lock is designed or intended, or 0.25× or about 0.25× that width, or 0.5× or about 0.5× that width, or 0.75× or about 0.75× that width, or 1.25× or about 1.25× that width, or 1.5× or about 1.5× that width, or 1.75× or about 1.75× that width, or 2× or about 2× that width, or 2.25× or about 2.25× that width, or 2.5× or about 2.5× that width, or 3× or about 3× that width, or 3.5× or about 3.5× that width, or 4× or about 4× that width, or 4.5× or about 4.5× that width, or 5× or about 5× that width, or 0.25×-5× or about 0.25×-5× that width, or 0.5×-4× or about 0.5×-4× that width, or 1×-3× or about 1×-3× that width, or 1×-2× or about 1×-2× that width.

A bar of a cord lock of the current invention, in certain embodiments, comprises teeth. Teeth of a bar of the current invention may be located on a side edge, a top side and/or a bottom side of the bar. A tooth of a bar of a cord lock of the current invention, in certain embodiments, comprises an elevation and/or an indentation. In certain preferred embodiments, a bar of the current invention comprises teeth on both side edges and/or on the top and bottom side of the bar. A tooth of a bar of a cord lock of the current invention, in certain embodiments, is of a shape and size to facilitate locking and unlocking the bar by the locking mechanism of the cord lock. A tooth of a bar of a cord lock of the current invention, in certain embodiments, has a shape that is a triangle, a square, a rectangle, a diamond, a half sphere, and/or any other shape. Teeth of a bar of the current invention, in certain embodiments, may all have the same shape or they may have different shapes.

A section of a bar of a cord lock of the current invention that has teeth along one or both of its side edges and/or along its top and/or bottom side, in certain embodiments, comprises the entire length of the bar, or the entire length of the bar except for a bar stop of the bar, or the entire length of the bar except for a pigtail section of the bar, or the entire length of the bar except for a bar stop and a pigtail section of the bar. A section of a bar of a cord lock of the current invention that has teeth along one or both of its side edges and/or along its top and/or bottom side, in certain embodiments, comprises 20-100 percent or about 20-100 percent of the length of the bar, with the length determined by measuring the length of the entire side edge or top or bottom side, or 30-90 percent or about 30-90 percent, or 40-80 percent or about 40-80 percent, or 50-70 percent or about 50-70 percent, or 40-60 percent or about 40-60 percent. A bar of the current invention, in certain embodiments, has teeth along both of its side edges over a section that is of the same length on both sides or that is of different length on both sides. A bar of the current invention, in certain embodiments, has teeth along both its top and bottom side over a section that is of the same length on the top and bottom or that is of different length on the top and bottom.

A bar of a cord lock of the current invention, in certain embodiments, has a width and a thickness that allow moving the bar through a locking mechanism of the cord lock, if the locking mechanism is in an unlocked setting. A teeth-carrying section of a bar of a cord lock of the current invention, in certain embodiments, cannot be moved through a locking mechanism of the cord lock, if the locking mechanism is in a locked setting.

A bar of a cord lock of the current invention, in certain embodiments, is made of a plastic, a metal, a wood, or another material. A bar of a cord lock of the current invention, in certain embodiments, may be made of more than one material, for example, two, three, four, five, or more materials. Different sections of a bar of a cord lock of the current invention, in certain embodiments, may be made of different materials. In certain embodiments, a pigtail of a bar of the current invention is made of a material that is somewhat soft, elastic and/or bendable to facilitate and/or improve the introduction of a cord into a pigtail opening of the pigtail. In certain embodiments, a teeth-carrying section of a bar of the current invention may be of a material that is hard, non-elastic and/or non-bendable, for example, to facilitate and/or improve the locking of the cord lock and/or the interaction of the bar with a locking mechanism. In certain embodiments, a bar stop of a bar of the current invention may be of a material that is hard, non-elastic and/or non-bendable, for example, to facilitate and/or improve that the bar stop cannot move through a locking mechanism of the cord lock.

A bar of a cord lock of the current invention, in certain embodiments, comprises a pigtail on one end of the bar or a pigtail on each end of the bar. In a preferred embodiment, a pigtail of a bar has a shape of a loop, a spiral, and/or a circle that is not fully closed. A pigtail of a bar of the current invention, in certain embodiments, has an opening that allows introducing a cord on which the bar is used into the opening of the pigtail. A cord may be introduced into a pigtail opening of a bar of the current invention, in certain embodiments, by bending the end of the pigtail to enlarge access to the pigtail opening and thereby facilitating introduction of the cord into the pigtail opening.

A pigtail opening of a bar of the current invention, in certain embodiments, has a diameter that is larger than the diameter of a cord on which the bar is used, or 1.01× or about 1.01× that diameter, or 1.05× or about 1.05× that diameter, or 1.1× or about 1.1× that diameter, or 1.2× or about 1.2× that diameter, or 1.3× or about 1.3× that diameter, or 1.4× or about 1.4× that diameter, or 1.5× or about 1.5× that diameter, or 1.7× or about 1.7× that diameter, or 2× or about 2× that diameter, or 2.5× or about 2.5× that diameter, or 3× or about 3× that diameter, or 1.01×-3× or about 1.01×-3× that diameter, or 1.05×-2.5× or about 1.05×-2.5× that diameter, or 1.1×-2× or about 1.1×-2× that diameter, or 1.2×-1.7× or about 1.2×-1.7× that diameter, or 1.05×-1.5× or about 1.05×-1.5× that diameter, or 1.1×-1.3× or about 1.1×-1.3× that diameter.

A pigtail opening of a bar of a cord lock of the current invention, in certain embodiments, has a diameter that does not permit a cord plug of the cord on which the cord lock is used to pass through the pigtail opening. A pigtail opening of a bar of a cord lock of the current invention, in certain embodiments, has a diameter that does not permit two cord plugs of the cord on which the cord lock is used to pass through the pigtail opening. A pigtail opening of a bar of a cord lock of the current invention, in certain embodiments, has a diameter that does not permit all cord plugs of the cord on which the cord lock is used to pass through the pigtail opening.

A pigtail of a bar of a cord lock of the current invention, in certain embodiments, pushes a cord plug towards a connection and/or holds the cord plug in a connection, when the cord lock is used, for example, to lock and/or secure a connection of cords.

In certain embodiments, a bar of a cord lock of the current invention comprises a structure that can fulfill the function of holding and/or securing a cord plug, for example, in a connection of cords. A structure that can fulfill the function of holding and/or securing a cord plug, in certain embodiments, comprises a pigtail, a loop, a band, a sling, a hook, a fastener, a spiral, and/or an open circle, and/or a combination of two or more of these structures.

A bar of a cord lock of the current invention, in certain embodiments, comprises a bar stop on one end of the bar or a bar stop on each end of the bar. A bar stop of a bar of a cord lock of the current invention, in certain embodiments, impedes movement of the bar through a locking mechanism of the cord lock. A bar stop of a cord lock of the current invention, in certain embodiments, has a width and a thickness that do not allow moving the bar stop through a locking mechanism of the cord lock, if the locking mechanism is in a locked setting. A bar stop of a cord lock of the current invention, in certain embodiments, has a width and a thickness that do not allow moving the bar stop through a locking mechanism of the cord lock, if the locking mechanism is in an unlocked setting.

A locking mechanism of a cord lock of the current invention, in certain embodiments, is capable of holding on to a power cord, for example, to a male plug of a power cord, to a female plug of a power cord, and/or to a cord of a power cord. A locking mechanism of a cord lock of the current invention, in certain embodiments, is capable of holding on to a bar and/or a fastening band of a cord lock of the current invention.

A locking mechanism of a cord lock of the current invention, in certain embodiments, is capable of holding on to a bar of a cord lock of the current invention. In certain embodiments, a locking mechanism of the current invention comprises a space that can hold a bar of the current invention, preferably a teeth-carrying section of a bar of the current invention. In certain embodiments, a space in a locking mechanism of the current invention for holding a bar allows the bar to extend through the locking mechanism so that a locking structure can reach the bar, preferably a teeth-carrying section of the bar. A locking structure of a locking mechanism of the current invention, in certain embodiments, comprises a locking arm, a locking pin, a locking wheel, a locking button, and/or any other structure capable of locking a bar of the invention in position, or a combination of two or more thereof. In certain embodiments, a space in a locking mechanism of the current invention for holding a bar comprises a channel, a tunnel, a groove, an indentation, and/or two or more thereof.

A locking mechanism of the current invention, in certain embodiments, automatically and/or mechanically attempts to lock a bar in the locking mechanism into a position, for example, so that the bar cannot be moved at all or not as easily. A locking mechanism of the current invention, in certain embodiments, automatically and/or mechanically locks a bar in the locking mechanism into a position through a force generated by a spring, a blade, a flexible plastic, an elastic material, and/or by some other means. A locking mechanism of the current invention, in certain embodiments, allows moving a bar in the locking mechanism out of position if the locking mechanism is deactivated and/or disengaged. A locking mechanism of the current invention, in certain embodiments, may be deactivated and/or disengaged by application of force by a user of the cord lock to neutralize and/or counteract a force that automatically and/or mechanically locks a bar in the locking mechanism into a position, for example, a user may apply force on a locking arm so that teeth of a bar no longer engage the locking arm.

A locking mechanism of a cord lock of the current invention, in certain embodiments, comprises a body, a body platform, a body pivot point, a locking arm, a locking arm right angle surface, a locking arm slanted surface, a locking arm finger tab, a locking arm spring, a locking arm hinge pin, and/or any combination thereof. A locking arm of a cord lock of the current invention, in certain embodiments, comprises a locking arm right angle surface, a locking arm slanted surface, and/or a locking arm finger tab.

A fastening band of a cord lock of the current invention, in certain embodiments, is capable of holding on to a cord, for example, to a male plug of a power cord, to a female plug of a power cord, and/or to a cord of a power cord. A fastening band of a cord lock of the current invention, in certain embodiments, is capable of holding on to a locking mechanism of a cord lock of the current invention. A cord lock of the current invention, in certain embodiments, comprises one, two, three, four, five, six, or more fastening bands. A fastening band of a cord lock of the current invention, in certain embodiments, is capable of preventing or substantially reducing movement of the cord lock relative to a cord and/or plug on which the cord lock is used.

A fastening band of a cord lock of the current invention, in certain embodiments, comprises a band, a strip, a string, a claw, a housing, a cover, a case, a frame, and/or a structure that can hold on to a cord, a male plug, and/or a female plug on which a cord lock of the current invention is to be used. A fastening band of a cord lock of the current invention, in certain embodiments, comprises a band, a strip, a string, a claw, a housing, a cover, a case, a frame, and/or a structure that can be attached to a locking mechanism of a cord lock of the current invention.

A fastening band of a cord lock of the current invention, in certain embodiments, is attached to a cord, a male plug, and/or a female plug by wrapping and/or extending the fastening band around the cord and/or plug. A fastening band of the current invention, in certain embodiments, is attached to a cord and/or a plug by wrapping the fastening band around the cord and/or plug and by connecting sections of the fastening band to each other, for example, through a knot, Velcro, a button, a hook, any other known means, and/or a combination thereof. A fastening band of a cord lock of the current invention, in certain embodiments, is attached to a cord and/or a plug by wrapping the fastening band around the cord and/or plug and by connecting it to a locking mechanism of the cord lock, for example, through a knot, Velcro, a button, a hook, a zip tie, a clamp, any other known means, and/or a combination thereof.

A cord lock of the current invention, in certain embodiments, is shaped to fit over cords and plugs that it is used with. A cord lock of the current invention, in certain embodiments, is an integral part of a power cord, and such a cord lock may not comprise a fastening band. A cord lock of the current invention that is an integral part of a power cord, in certain embodiments, may be connected to a plug and/or a cord at a component of the locking mechanism, for example, at a body, a body platform, and/or a body pivot point. A cord lock of the current invention, in certain embodiments, facilitates replacing individual components to allow maintenance and/or repair without the need to replace the entire cord lock and/or without the need to replace a cord and/or plug to which the cord lock may be attached.

A cord lock of the current invention, and its various components, may be made of any material, for example, a plastic, a rubber, a metal, a wood, or any other material that is sufficiently strong and flexible. In certain embodiments, the invention relates to methods for locking power plugs with a cord lock of the invention. A method of the current invention, in certain embodiments, prohibits or inhibits the separation of a male and a female cord plug so that said separation is less likely, significantly less likely, almost impossible, and/or impossible. In certain embodiments, a cord lock of the current invention remains fastened to a cord when the cord is not in use.

Cord locks according to certain embodiments of the current invention are further exemplified in the figures. In FIG. 1 there is shown a cord lock according to certain embodiments that is applied to a female cord plug 2 attached to a cord on a female end 1. A pigtail 14 is applied to a cord on a male end 3 next to a male cord plug 4. Also exemplified is a bar 15 with teeth on both side edges with a bar stop 16. A locking mechanism is exemplified with a body 5, a body platform 6, locking arms 8 that can pivot around locking arm hinge pins 13 between locking and unlocking the bar 15. As shown in this example, the locking arms 8 are in the locked position because the end of the locking arms 8 that is closer to the bar stop 16 is positioned away from the body 5, while the other end is positioned close to the body 5. Also exemplified are fastening bands 19.

Figure 2:
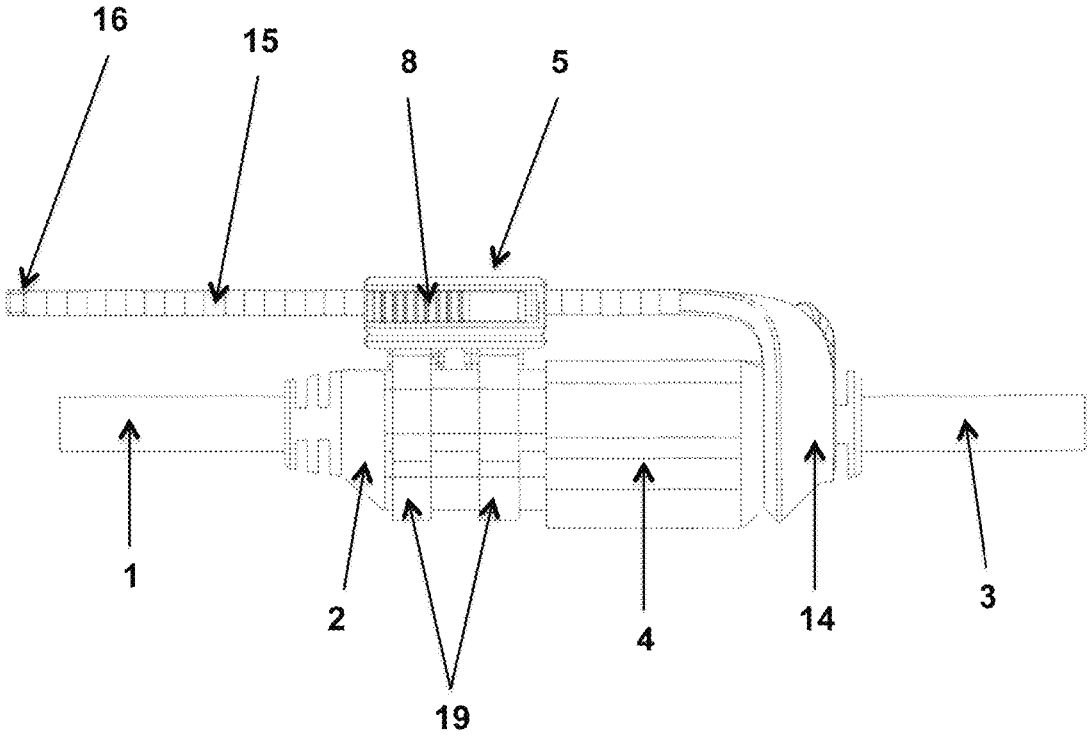
FIG. 2 shows a side view of the embodiment in FIG. 1.
Figure 3:
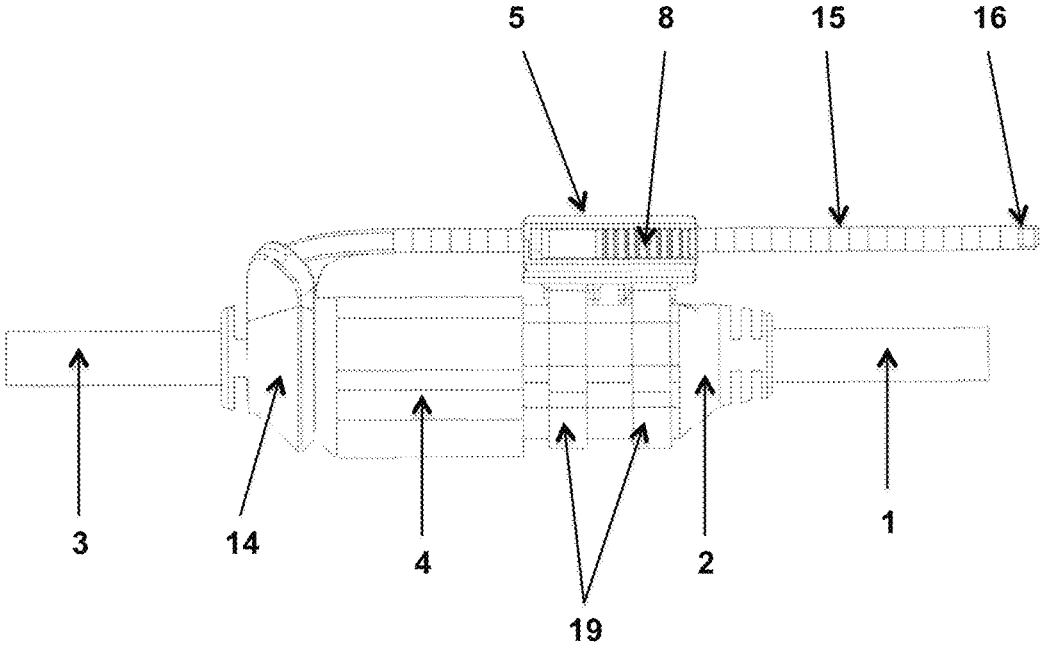
FIG. 3 shows another side view of the embodiment in FIG. 1.

In FIG. 2 and FIG. 3 there are shown a side views of a cord lock according to certain embodiments as shown in FIG. 1. Exemplified in FIG. 2 and FIG. 3 are a cord on a female end 1, a female cord plug 2, a cord on a male end 3, and a male cord plug 4. Also exemplified is a bar 15 with a bar stop 16 and a pigtail 14. Further exemplified is a locking mechanism with a body 5 and a locking arm 8. Finally, fastening bands 19 are also exemplified.

Figure 4:
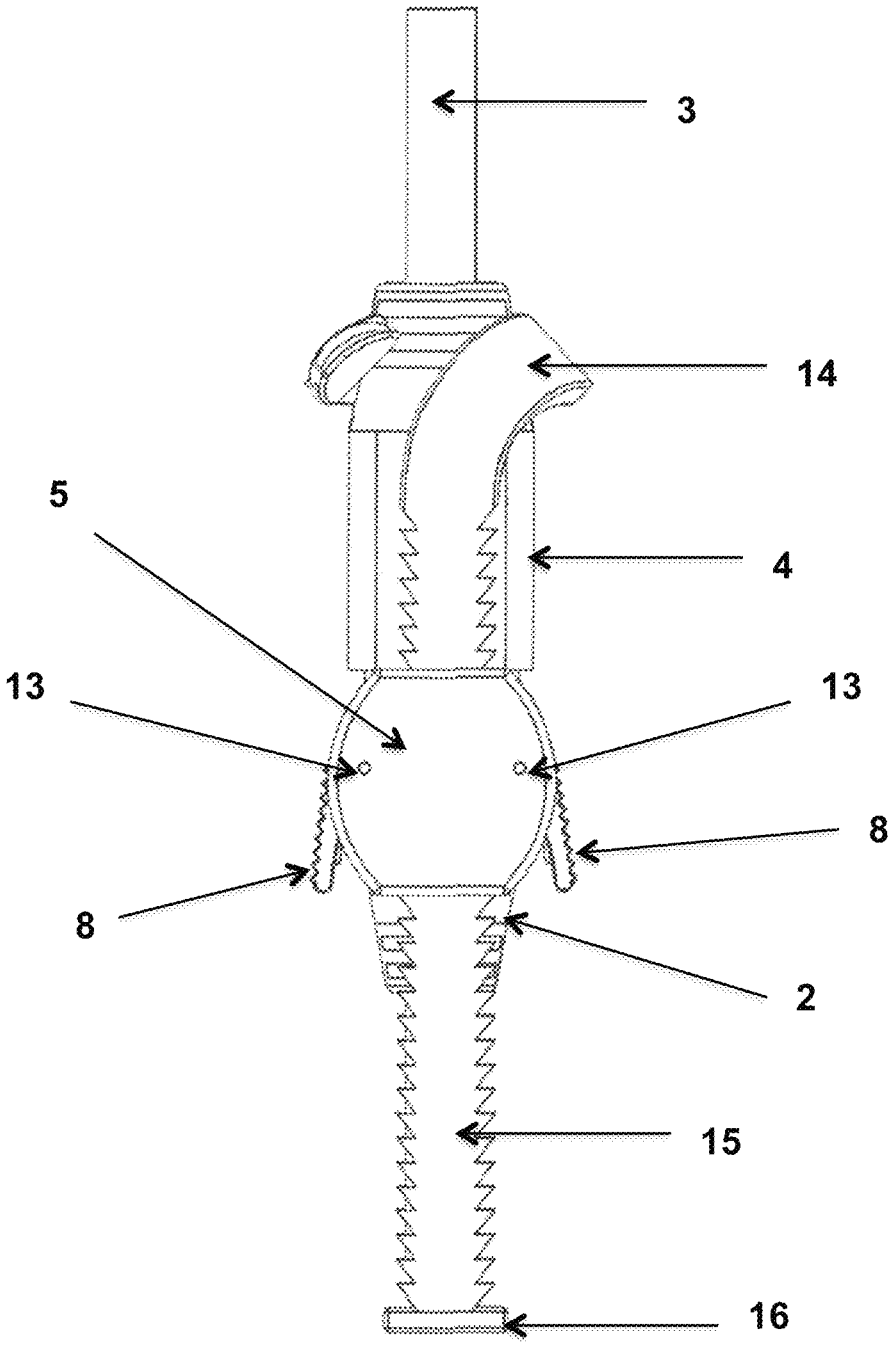
FIG. 4 shows a top view of the embodiment in FIG. 1.

In FIG. 4 there is shown a top view of a cord lock according to certain embodiments as shown in FIG. 1. Exemplified in FIG. 4 are a female cord plug 2, a cord on a male end 3, and a male cord plug 4. Also exemplified is a bar 15 carrying teeth with a bar stop 16 and a pigtail 14. Further exemplified is a locking mechanism with a body 5, locking arms 8 and locking arm hinge pins 13.

Figure 5:
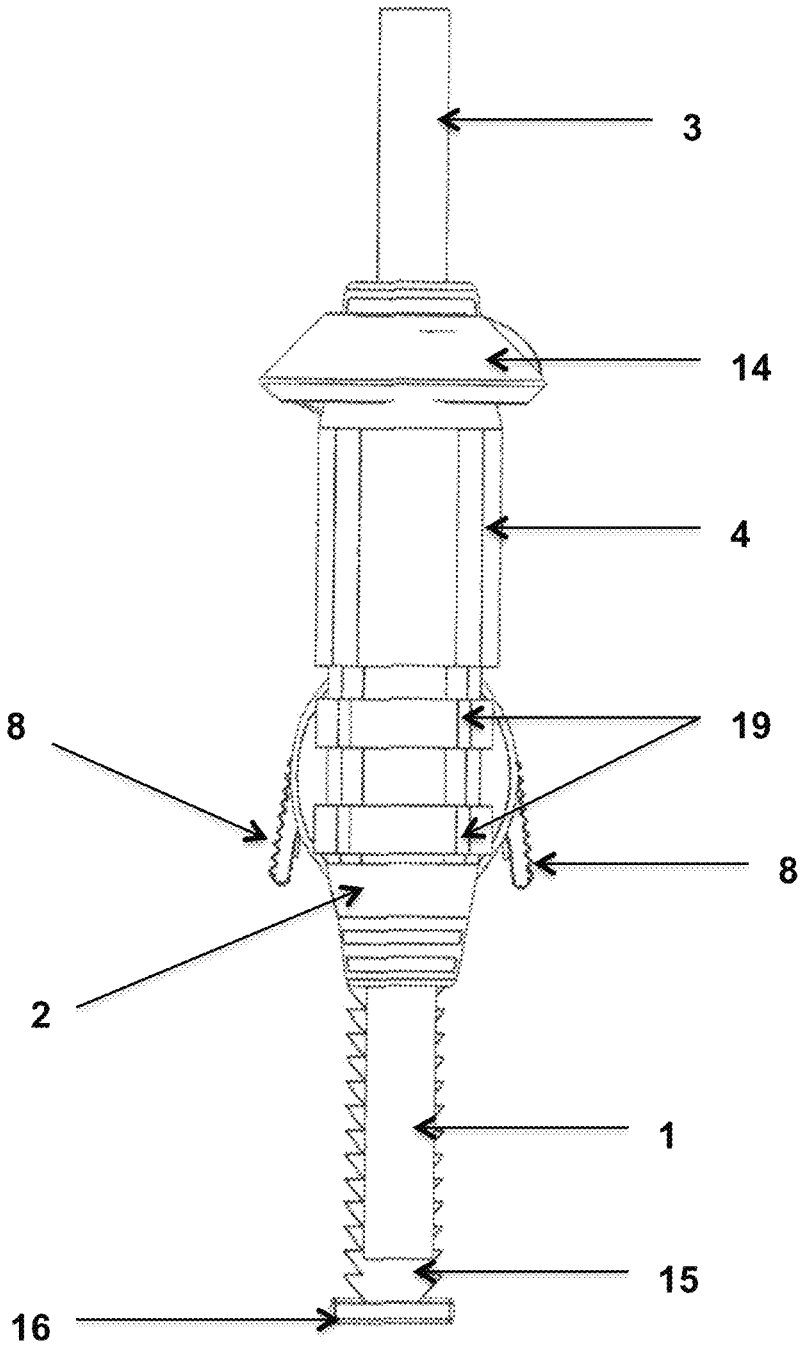
FIG. 5 shows a bottom view of the embodiment in FIG. 1.

In FIG. 5 there is shown a bottom view of a cord lock according to certain embodiments as shown in FIG. 1. Exemplified in FIG. 5 are a cord on a female end 1, a female cord plug 2, a cord on a male end 3, and a male cord plug 4. Also exemplified is a bar 15 carrying teeth with a bar stop 16 and a pigtail 14. Further exemplified is a locking mechanism with locking arms 8. Finally, fastening bands 19 are also exemplified.

In FIG. 6 there is shown a perspective view of a cord lock according to certain embodiments as shown in FIG. 1. The bar 15 is in a more extended position than shown in FIG. 1 and the bar 15 is rotated away from the cord 3 whereby the cord 3 and the cord plug 4 are easier to access. Exemplified in FIG. 6 are a cord on a female end 1, a female cord plug 2, a cord on a male end 3, and a male cord plug 4. Also exemplified is a bar 15 carrying teeth with a bar stop 16, a pigtail 14 and a pigtail opening 20. Further exemplified is a locking mechanism with a body 5, locking arms 8 and locking arm hinge pins 13. Finally, fastening bands 19 are also exemplified.

In FIG. 7 there is shown a perspective view of a cord lock according to certain embodiments as shown in FIG. 1. The bar 15 is in a more extended position than shown in FIG. 1 and the cord 3 is inside the pigtail opening 20 of the pigtail 14. For locking the plugs 2, 4 together, the pigtail 14 is moved towards the body 5 of the locking mechanism so that the pigtail 14 contacts and/or pushes against the male cord plug 4, thus making is less likely that the plugs 2, 4 with disconnect. Exemplified in FIG. 7 are a cord on a female end 1, a female cord plug 2, a cord on a male end 3, and a male cord plug 4. Also exemplified is a bar 15 carrying teeth with a bar stop 16, a pigtail 14 and a pigtail opening 20. Further exemplified is a locking mechanism with a body 5, locking arms 8 and locking arm hinge pins 13. Finally, fastening bands 19 are also exemplified.

In FIG. 8 there is shown a perspective view of a cord lock according to certain embodiments that is applied to a female cord plug 2, and wherein the cord plug 2 is not connected to another cord plug or an outlet. Exemplified is a bar 15 with a bar stop 16 and a pigtail 14 that is in an orientation that is reversed by 180 degrees when compared to the orientation in which the cord lock is used to hold cord plugs together. The extension cord on a female end 1 passes through the pigtail opening 20. Also exemplified are a body 5, locking arms 8 and locking arm hinge pins 13. Finally, fastening bands 19 are also exemplified.

In FIG. 9 there is shown an end view of a cord lock according to certain embodiments. Exemplified are a cord on a male end 3, a pigtail 14 and a pigtail opening 20. Further exemplified is a locking mechanism with a body 5 and locking arms 8.

In FIG. 10 there is shown an end view of a cord lock according to certain embodiments. Exemplified are a cord on a female end 1, a female cord plug 2, a pigtail 14, a bar stop 16, and a fastening band 19. Further exemplified is a locking mechanism with a body 5, a body platform 6, a body pivot point 7 to facilitate rotating the bar, for example, as shown in FIG. 6. Also exemplified are locking arms 8, locking arm springs 12 and locking arm spring extensions 12*a*.

In FIG. 11 there is illustrated the function of a locking mechanism of a cord lock according to certain embodiments. Exemplified are a bar 15 carrying teeth with a bar teeth right angle surface 17, and a bar teeth slanted surface 18. Also exemplified are locking arms 8 with a locking arm right angle surface 9, a locking arm slanted surface 10, a locking arm finger tab 11, locking arm spring extensions 12*a*, and locking arm hinge pins 13. The locking arm spring extensions 12*a* pressure the locking arm finger tabs 11 in a direction away from the bar 15, whereby the locking arm right angle surface 9 and the locking arm slanted surface 10 are pressured in the direction of the bar teeth right angle surface 17 and the bar teeth slanted surface 18. The bar 15 is locked when a locking arm right angle surface 9 contacts a bar teeth right angle surface 17 and a locking arm slanted surface 10 contacts a bar teeth slanted surface 18.

In FIG. 12 there is illustrated the function of a locking mechanism without hinge pins of a cord lock according to certain embodiments. Exemplified are a bar 15 carrying teeth with a bar teeth right angle surface 17, and a bar teeth slanted surface 18. Also exemplified are locking arms 21 with a locking arm finger tab 22, a locking arm right angle surface 23, and a locking arm slanted surface 24. The locking arms 21 include locking extensions 25 that are attached to the body 26. The locking arms 21 pressure the locking arm finger tabs 22 in a direction away from the bar 15, whereby the locking arm right angle surface 23 and the locking arm slanted surface 24 are pressured in the direction of the bar teeth right angle surface 17 and the bar teeth slanted surface 18. The bar 15 is locked when a locking arm right angle surface 23 contacts a bar teeth right angle surface 17 and a locking arm slanted surface 24 contacts a bar teeth slanted surface 18.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited publications, patents, and patent applications are herein incorporated by reference in their entirety for any purpose.

What is claimed is:

1. A cord lock comprising a bar and a locking mechanism comprising a body, a body platform, wherein the bar comprises teeth, wherein said teeth are on a side edge of said bar, wherein said bar extends through said locking mechanism, and wherein the locking mechanism comprises a locking arm capable of locking the bar to inhibit movement of the bar in the locking mechanism, said locking arm being capable of engaging said teeth, and wherein said body can be rotated together with said bar relative to said body platform.

2. A cord lock according to claim 1, wherein said bar comprises a bar stop.

3. A cord lock according to claim 1, wherein said bar comprises a pigtail.

4. A cord lock according to claim 1, wherein said bar comprises a bar tooth right angle surface and a bar tooth slanted surface.

5. A cord lock according to claim 1, wherein said bar comprises side edges and wherein said teeth are on said side edges.

6. A cord lock according to claim 1, wherein said teeth comprise an elevation or an indentation or both.

7. A cord lock according to claim 1, wherein said locking mechanism is capable of automatically locking movement of said bar through a force generated by a spring, a blade, a flexible plastic, and/or an elastic material.

8. A cord lock according to claim 1, wherein said locking mechanism comprises a locking arm finger tab, a locking arm spring, and a locking arm hinge pin.

9. A cord lock according to claim 1, wherein said locking mechanism comprises a locking arm right angle surface, and a locking arm slanted surface.

10. A method for inhibiting the separation of a male and a female cord plug by securing said male and female cord plug with a cord lock comprising a bar and a locking mechanism comprising a body, a body platform, wherein the bar comprises teeth, wherein said teeth are on a side edge of said bar, wherein said bar extends through said locking mechanism, and wherein the locking mechanism comprises a locking arm capable of locking the bar to inhibit movement of the bar in the locking mechanism, said locking arm being capable of engaging said teeth, and wherein said body can be rotated together with said bar relative to said body platform.

11. A method according to claim 10, wherein said bar comprises a bar stop.

12. A method according to claim 10, wherein said bar comprises a pigtail.

13. A method according to claim 10, wherein said bar comprises a bar tooth right angle surface and a bar tooth slanted surface.

14. A method according to claim 10, wherein said bar comprises side edges and wherein said teeth are on said side edges.

15. A method according to claim 10, wherein said teeth comprise an elevation or an indentation or both.

16. A method according to claim 10, wherein said locking mechanism is capable of automatically locking movement of said bar through a force generated by a spring, a blade, a flexible plastic, and/or an elastic material.

17. A method according to claim 10, wherein said locking mechanism comprises a locking arm finger tab, a locking arm spring, and a locking arm hinge pin.

18. A method according to claim 10, wherein said locking mechanism comprises a locking arm right angle surface, and a locking arm slanted surface.

* * * * *